US010669690B2

(12) United States Patent
Doherty et al.

(10) Patent No.: US 10,669,690 B2
(45) Date of Patent: Jun. 2, 2020

(54) WORK ATTACHMENT ASSEMBLIES

(71) Applicant: Doherty Engineered Attachments Limited, Mount Maunganui (NZ)

(72) Inventors: Jeremy Glen Doherty, Papamoa (NZ); Paul James Doherty, Papamoa (NZ)

(73) Assignee: Doherty Engineered Attachments Limited, Mount Maunganui (NZ)

( * ) Notice: Subject to any disclaimer, the term of this patent is extended or adjusted under 35 U.S.C. 154(b) by 0 days.

(21) Appl. No.: 15/894,225

(22) Filed: Feb. 12, 2018

(65) Prior Publication Data

US 2019/0085526 A1 Mar. 21, 2019

Related U.S. Application Data

(63) Continuation of application No. 13/127,450, filed as application No. PCT/NZ2009/000236 on Nov. 3, 2009, now abandoned.

(30) Foreign Application Priority Data

Nov. 3, 2008 (NZ) ..... 572477

(51) Int. Cl.
*E02F 3/36* (2006.01)

(52) U.S. Cl.
CPC ..... *E02F 3/3618* (2013.01); *E02F 3/365* (2013.01); *E02F 3/3622* (2013.01); *E02F 3/3645* (2013.01); *E02F 3/3654* (2013.01); *E02F 3/3677* (2013.01); *Y10T 29/49815* (2015.01); *Y10T 403/24* (2015.01)

(58) Field of Classification Search
CPC ..... E02F 3/3663; E02F 3/3618; E02F 3/3622; E02F 3/3627
USPC ..... 37/468
See application file for complete search history.

(56) References Cited

U.S. PATENT DOCUMENTS

| | | | | |
|---|---|---|---|---|
| 5,692,325 | A | 12/1997 | Kuzutani | |
| 6,132,131 | A | 10/2000 | Nakamura et al. | |
| 6,379,075 | B1 | 4/2002 | Shamblin et al. | |
| 6,899,509 | B1 | 5/2005 | Mailleux | |
| 6,902,346 | B2 | 6/2005 | Steig et al. | |
| 6,964,122 | B2 | 11/2005 | Cunningham et al. | |
| 7,473,067 | B2 | 1/2009 | Nishioka et al. | |
| 7,493,712 | B2 | 2/2009 | McCormick et al. | |
| 7,648,305 | B2 | 1/2010 | Beales | |
| 2006/0070270 | A1 * | 4/2006 | Short | E02F 3/3613 37/468 |

FOREIGN PATENT DOCUMENTS

| | | |
|---|---|---|
| GB | 2424637 | 10/2006 |
| NZ | 524628 | 3/2003 |

(Continued)

OTHER PUBLICATIONS

Doherty, "Multilock Quick Coupler Installation and Maintenance Manual." Jan. 2004.
Doherty, :Multilock Quick Coupler Brochure. 2003.

*Primary Examiner* — Thomas B Will
*Assistant Examiner* — Joel F. Mitchell
(74) *Attorney, Agent, or Firm* — Lewis Kohn & Walker LLP; David M. Kohn; Kari Moyer-Henry

(57) ABSTRACT

Improvements to work attachment assemblies and in particular work attachment assemblies for use with work machines such as excavators.

14 Claims, 18 Drawing Sheets

(56) References Cited

FOREIGN PATENT DOCUMENTS

| | | |
|---|---|---|
| WO | 2006083172 | 8/2006 |
| WO | 2008029112 | 3/2008 |
| WO | 2008051095 | 5/2008 |

* cited by examiner

WORK ATTACHMENT ASSEMBLIES

CROSS REFERENCES

This application is a Continuation Application claiming priority from United States National Stage application Ser. No. 13/127,450 filed Aug. 3, 2011 which claims priority under 35 U.S.C. 371 from International Patent Application No. PCT/NZ2009/000236 filed on Nov. 3, 2009, which claims the benefit of priority from New Zealand Patent Application No. 572477, filed on Nov. 3, 2008, the entire contents of which are herein incorporated by reference.

TECHNICAL FIELD

The present invention relates to improvements to work attachment assemblies and in particular work attachment assemblies for use with work machines such as excavators.

BACKGROUND ART

Work machines such as excavators use a variety of work attachments. These attachments include buckets, graders, grapples or drilling attachments.

It is desirable to have a releasable attachment between the construction vehicle and the work attachment to easily and rapidly change the work attachment.

Generally, a releasable attachment is provided by two or more jaws which engage pins on the work attachment. At least one of the jaws is moveable in a pivotal or sliding motion.

The first jaw receives a pin and the second jaw moves to engage the second pin.

An actuator forces the jaw against the pin. This retains the pin in the jaw thereby securing the work attachment to the machine.

It is known to use a locking portion as an added safety measure. This secures a pin in a jaw.

In one form of coupling a person manually inserts a member to act as a locking portion. However, this involves the operator getting out of the excavator and getting close to the work attachment.

There are alternate embodiments where a locking portion is operatively coupled to the moveable jaw. In these, movement of the jaw controls movement of the locking portion to either retain or release a pin from the other jaw.

An improvement to the commonly available coupling assemblies is that disclosed in PCT Application No. NZ2007/000320 to JB Sales International Limited.

The JB Sales patent discloses a coupling having a body on an excavator arm with two jaws to receive pins on a work attachment. One of the jaws is slidable with respect to the body so that it can engage a pin on the work attachment.

The slideable jaw is configured to control a pivotally mounted retention member. This member therefore retains a second pin when the first jaw is not actuated to a position beyond that it assumes when receiving the first pin.

Due to the opposite facing of the jaws, the mounting must be tilted to allow the second jaw to extend beyond the locking position.

However, the assembly disclosed by the JB Sales patent has a number of limitations.

One of these disadvantages is the mounting of the retention member to the body. Over time the pressure exerted on the retention member by the moveable jaw causes wear and tear. The retention member may therefore be prone to failure.

In addition, the retention member only secures a second pin in the second jaw when the first jaw is in the correct position. Due to this securing the work attachment to the mounting is dependant on the position of the moveable jaw. Should the actuator or moveable jaw fail with the coupler in an inverted position, the effectiveness of the retention member is compromised, and this could pose a safety risk.

A further disadvantage of the JB Sales patent is that the pin is not secured in the jaw immediately at being inserted into a jaw. Rather the operator must elect to retract an actuator so that the retention member secures the pin inside the jaw. This is an issue as research indicates that most accidents involving the accidental dropping of a work attachments occur during the connection process. The JB Sales patent therefore does not address a major safety issue with releasably connected work attachments.

Further, more stringent safety regulations (presently in a draft form) would make it useful to have a release mechanism requiring more than three stages. This is because forcing an operator to take additional steps may help to ensure that work attachments are not accidentally released from an excavator.

Ideally, this assembly should be more durable and less prone to mechanical failure than coupling assemblies available.

When in use, a boom arm controls the position and most of the operative movement of the work attachment. However additional actuators are used to provide more control over movement of the work attachment. This may include the tilting action of a bucket, or to operate a drilling machine.

These actuators are generally secured on the work attachment. Therefore, it is necessary to have a releasable connection between the actuators on a work attachment, and a control system. Generally, this occurs using complementary hydraulic hose connectors on the work attachment and boom arm.

Connecting the complementary connectors is a manual process requiring an operator to switch off the excavator to relieve residual oil pressure and then climb out of the excavator to connect by hand.

Therefore, it would be an advantage to have an assembly which automatically aligns and locks connectors. Further, that assembly should allow them to release each other when required.

Yet another disadvantage of the available connectors in the prior art is that they are exposed when not in use. They can therefore be knocked causing damage or contaminated by the ingress of dirt. This may result in sealing issues, leading to the escape of oil from the connectors. It can therefore affect the overall performance of the connectors.

It would be an advantage to have a system to protect connectors from these types of damage.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

It is an object of the present invention to address the foregoing problems or at least to provide the public with a useful choice.

Further aspects and advantages of the present invention will become apparent from the ensuing description which is given by way of example only.

DISCLOSURE OF THE INVENTION

According to one aspect of the present invention there is provided a coupler, including jaws to engage pins and thereby secure a work attachment to the coupler, wherein at least one of the jaws is moveable with respect to the coupler, characterised in that the coupler includes a safety link.

According to another aspect of the present invention there is provided a method of releasing a work attachment from a coupler, wherein the work attachment is secured to the coupler via two pins held within two jaws, the method including the steps of:

(a) moving a first jaw to release a first pin;

(b) changing the orientation of the coupler and work attachment relative to each other;

(c) moving the first jaw in the opposite direction to that in step (a);

(d) moving the first jaw in the opposite direction to that in step (c);

the method characterised in that the action of step (c) causes a safety link to move to a release position so that the locking portion will release a pin from the second jaw in step (d).

According to another aspect of the present invention there is provided an assembly to provide a releasable connection between a device on a work attachment and a control system, wherein the work attachment is secured to a machine via a coupler, the assembly including:

a first mounting having first set of connectors, and a second mounting having a second set of connectors corresponding to the first set of connectors, and at least one guard to protect one of the sets of connectors characterised in that the guard or the mountings can move with respect to each other to expose the first and second sets of connectors and allow these to engage.

According to another aspect of the present invention, there is provided a method of providing a releasable connection between a device on a work attachment and a control system, wherein the work attachment is secured to a work machine via a coupler, the method including the steps of (a) orientating the coupler into a position to engage the work attachment and secure this to the machine, the method characterised by the step of (b) moving a guard or mountings with respect to each other to expose a first set of connectors and a second set of connectors so that these can engage with each other.

Preferably there is provided a mounting for use with connectors, the mounting including a plurality of connectors, a latch to secure the connectors to complementary connectors, the mounting characterised as having a release portion.

Preferably there is provided a method of releasing pairs of engaged connectors, the method including the steps of:

(a) moving two mountings with respect to each other, wherein the two mountings have pairs of engaged connectors, characterised in that the action of step (a) causes at least one of each pair of engaged connectors to abut a release portion thereby releasing the pairs of engaged connectors from each other.

The present specification discloses a number of inventions relating to improvements to the releasable attachment of work attachments to machines.

In preferred embodiments the inventions disclosed are intended for use together and reference herein will be made as such. However, the present inventions could be used independently of the other and therefore the description herein should not be seen as limiting.

Preferably the machine may be an excavator or other construction vehicle. Reference herein will be made to the machine as an excavator.

However, the present inventions can be used with other types of machines where releasable work attachments are utilised including graders and bulldozers, loaders, tractors and scrapers.

Throughout the present specification reference to the term "work attachment" should be understood as meaning an implement for performing a task.

In a preferred embodiment the work attachment may be a digger bucket as known to those skilled in the art. Reference herein will be made to the work attachment as being a tilt bucket.

Alternatives for the work attachment include vibrating compactors and grapples used in the forestry industry for grasping and manipulating logs, hole boring augers, clamps, rotating screening buckets, work platforms, mowers, hedge cutters.

Throughout the present specification reference to the term "coupler" should be understood as meaning an assembly to secure a work attachment to an excavator.

In a preferred embodiment the coupler has two jaws that each engage a work attachment to thereby secure the work attachment to the coupler. Reference will be made accordingly.

Preferably the jaws may face in opposite directions. However, it is also envisaged that the jaws could face in the same direction.

In a preferred embodiment the moveable jaw is a slide as known to those skilled in the art. In this embodiment, movement of the jaw is in a sliding motion with respect to the coupler or bucket.

Alternatively, the jaw may pivot about a fixed point on the coupler.

Preferably movement of the jaw is controlled by an actuator such as a hydraulic cylinder.

Other types of actuators envisaged include a pneumatic cylinder, helical actuators, threaded manual actuators, springs, and chain drive assemblies.

Reference herein will be made to the term "actuator" as being a hydraulic cylinder.

In a preferred embodiment the hydraulic cylinder is floatingly mounted within the body.

Reference to the term "floatingly mounting" should be understood as meaning that the hydraulic cylinder is capable of moving in the coupler. That is, the hydraulic cylinder is not fixed at one or more points in the coupler. The hydraulic cylinder is able to contract and expand as per normal operation as should be known to those skilled in the art. However, the hydraulic cylinder is also able to move up and down with respect to the coupler.

In a particularly preferred embodiment the mounting of the hydraulic cylinder allows both ends of the hydraulic cylinder to move in the coupler.

In a preferred embodiment the moveable jaw of the coupler is secured to one end of the hydraulic cylinder. Therefore, expansion and contraction of the hydraulic cylinder moves the jaw with respect to the body.

In a preferred embodiment the present invention includes a track to guide movement of the hydraulic cylinder within the coupler.

In a particularly preferred embodiment the track guides movement of one end of the hydraulic cylinder so that the locking portion can release a pin from the jaw.

In one embodiment the track is a pin extending through the hydraulic cylinder and into channels on the coupler. The pin and channels allow the actuator to move within the coupler through a predetermined range of motion.

Alternatively, the hydraulic cylinder may be pivotally or slidably mounted to the coupler and therefore the foregoing should not be seen as limiting.

Throughout the present specification reference to the term "safety link" should be understood as meaning a component which controls whether the locking portion can be moved to release a pin from a jaw.

In doing so, the safety link is important in forcing an operator to make several movements to release a pin from a jaw.

In a preferred embodiment the safety link may cause expansion and/or contraction of the hydraulic cylinder to move the locking portion and thereby release a pin from the jaw.

Preferably, the safety link may be moveable between a safety position and a release position.

Throughout the present specification reference to the term "safety position" should be understood as meaning a position in which the safety link prevents a locking portion moving to release a pin from a jaw.

Throughout the present specification reference to the term "release position" should be understood as meaning a position in which the safety link does not prevent a locking portion moving to release a pin from a jaw.

In a preferred embodiment the safety link may be moved to the release position once the jaw is moved beyond the position in which it engages a pin. This may be achieved by extension of the hydraulic cylinder which moves the jaw and causes the safety link to contact a portion of the coupler, thereby moving the safety link into the release position.

In a particularly preferred embodiment, when in the release position the safety link causes expansion or contraction of the hydraulic cylinder to move the locking portion and thereby release a pin from a jaw.

In one such embodiment, when in the release position the safety link abuts a stop. As the safety link abuts the stop it prevents the first end of the hydraulic cylinder (and also the moveable jaw) moving past a specific point in the coupler.

If the hydraulic cylinder continues to contract this causes the second end of the hydraulic cylinder to move in the coupler. As the hydraulic cylinder is floatingly mounted within the coupler its second end moves with respect to the body and is guided by the track. This moves the locking portion, thereby releasing the pin from the jaw.

In the preferred embodiment when in the safety position the safety link does not abut the stop. Rather, the safety link moves within the coupler without contacting any obstructions—thereby allowing the hydraulic cylinder to fully contract by moving only its first end. This means that the hydraulic cylinder does not move the locking portion.

However, the foregoing should not be seen as limiting and alternatives are envisaged including those where the safety link is moved to the release position by a second actuator.

In a preferred embodiment the present invention includes a restricting portion.

In a preferred embodiment the coupler includes a restricting portion.

Throughout the present specification, the term "restricting portion" should be understood as meaning a component which controls and/or limits movement of the safety link.

Preferably, the restricting portion may hold the safety link in the safety position. However, the hold on the safety link is not so great that it cannot be overcome by another force to allow the safety link to move to the release position.

In a preferred embodiment the restricting portion may be a spring biased detent. The detent may extend into a complementary recess on the safety link.

Alternatively, the restricting portion may be a rubber mounting block or washer. This provides a frictional resistance to movement of the safety link so that it only moves when pressure is applied.

Throughout the present specification reference to the term "locking portion" should be understood as meaning a component which can secure a pin in a jaw.

In a preferred embodiment the locking portion may be formed in the hydraulic cylinder. In this embodiment the one end of the hydraulic cylinder is shaped to provide a recess or projection that can act as the locking portion.

Alternatively, the locking portion may be a pin pivotally mounted on the coupler or the moveable jaw. Therefore, the foregoing discussion of the locking portion should not be seen as limiting.

In a preferred embodiment the coupling may have a snap lock mechanism.

Throughout the present specification the term "snap lock mechanism" should be understood as meaning a mechanism to bias the locking portion to a locking position. The locking position is that in which the locking portion secures a pin in a jaw.

In this embodiment a biasing means may force the locking portion towards the locking position. However, the biasing means is not so strong that it cannot be overcome by the motion of inserting a pin into the jaw. In this embodiment, the action of moving a pin into the jaw moves the locking portion sufficiently to allow insertion of the pin into the jaw.

When the pin is substantially inside the jaw the biasing means forces the locking portion into the locking position thereby securing the pin in the jaw.

However, the foregoing should not be seen as limiting and alternatives are envisaged.

In a preferred embodiment the coupling may include a reset portion.

Throughout the present specification reference to the term "reset portion" should be understood as meaning a component which resets the safety link to the safety position.

In a particularly preferred embodiment the reset portion resets the safety link to the safety position after the locking portion has released a pin from a jaw.

Preferably, the reset portion is a protrusion extending from the hydraulic cylinder.

However, the protrusion may also be secured to the coupler or be formed integrally to the hydraulic cylinder. Therefore, the foregoing discussion should not be seen as limiting.

In a preferred embodiment the relative orientation of the work attachment and coupling is changed by tilting the coupler. This can be achieved by an operator moving the excavators' arm.

In an alternate embodiment the coupler and work attachment slide relative to each other. The important aspect of moving the coupler and work attachment relative to each other is so that the moveable jaw can move yet does not engage a pin on the bucket. It can therefore move past the position in which it engages a pin.

Throughout the present specification the term "connection assembly" should be understood as meaning an assembly to provide a connection between a control system and a device on a work attachment.

Throughout the present specification reference to the term "mounting" should be understood as meaning a component to support a plurality of connectors.

In a preferred embodiment the mountings may be housings that support and hold a set of connectors.

Preferably the present invention may include two mountings, one of which is secured to a coupler and one of which is secured to a work attachment with which the coupler is to be used.

Throughout the present specification reference to the term "guard" should be understood as meaning a component to protect connectors.

In a particularly preferred embodiment the present invention includes two guards. The first guard may protect a set of connectors in a housing on a coupler. The second guard may protect a set of connectors in a housing on a work attachment.

However, the foregoing should not be seen as limiting and it is envisaged that the connection assembly could also include one or more guards. This may vary from application to application depending on factors such as the type of connectors or the conditions which they may encounter.

In a preferred embodiment the guard(s) may close an open face of the housing (s) thereby protecting the connectors.

In a particularly preferred embodiment the guard to move to expose the sets of connectors. This action is preferably a pivot or slide. Causing the guard to pivot or slide may be achieved by the action of bringing a work attachment and coupler into alignment so that the coupler can secure the work attachment to a machine.

In a preferred embodiment the connection assembly may have an engagement portion to which pressure can be applied to move the guard.

The application of pressure to the engagement portion causes the guard(s) and mounting to move with respect to each other. Due to this movement the sets of connectors are exposed allowing them to engage.

However, it is also envisaged that the connection assembly may include an actuator to move a guard with respect to the mounting and thereby expose a set of connectors.

Throughout the present specification reference to the term "connector" should be understood as meaning components which can secure the parts of the control system to each other.

Preferably the connectors are hydraulic hose connectors as should be known to those skilled in the art. The connectors may also secure electrical wires or pneumatic tubes to each other.

Preferably, the connectors are complementary pairs of connectors which can engage. Once secured, the connectors provide a connection between controls in the excavator and an actuator on a work attachment.

In a preferred embodiment the connectors are Quick Release Connectors (QRCs) as known to those skilled in the art. In this embodiment the QRCs are complementary male and female connector halves. The female connector has a spring biased latch to secure the male and female halves relative to each other. Movement of the latch relative to the female connector causes engaged pairs of connectors to release each other.

In some embodiments the connector halves include a spring release mechanism to force the connector halves apart when the latch is released.

In a preferred embodiment, the housings include impact absorbers.

In this embodiment, the mountings may be mounted on compressible supports. These compressible supports may be formed from rubber or plastics materials, springs or air cushions.

The use of impact absorbers allows the present invention to better withstand knocks incurred during use of the work attachment or at engagement of the connectors.

In a preferred embodiment the connection assembly may include guides.

Throughout the present specification the term "guides" should be understood as referring to components that may help to line up set of connectors so that these can engage.

In a preferred embodiment, the guides may be tapered members extending from the first component of the hose connection assembly. In this embodiment, complementary recesses receive the tapered members.

The mountings facilitate the sets of connectors engaging by helping to ensure that these align with each other.

In a preferred embodiment, the connection assembly may have a plurality of biasing mountings. The biasing mountings secure and support the connectors on the mountings. They also urge these forward to ensure that the connectors are secured to each other. This feature is particularly important when the present invention is used with hydraulic hose connectors where it is critical to ensure that hydraulic fluid cannot escape from the hoses.

In a preferred embodiment the connection assembly may have a cleaning portion.

Throughout the present specification reference to the term "cleaning portion" should be understood as meaning a component which removes particulate matter from on or around the connectors and/or mounting.

Preferably the cleaning portion is mounted on the guard.

In a particularly preferred embodiment the mounting and housing move at an angle with respect to each other such that the mounting brushes across the cleaning portion. Having the mounting brush across the cleaning portion ensures that particulate matter is removed and cannot accidentally enter into the hose connectors.

In a preferred embodiment the cleaning portion is made from a bristle or similar. Alternatives include ridges made from rubber or plastic materials.

The present invention has a number of advantages. Firstly, the configuration of the safety link and locking portion force an operator to move the coupler through four or more steps to release a work attachment. Therefore, this reduces the chances of a work attachment being accidentally dropped from an excavator.

Further, the snap-lock mechanism makes it easier to secure a pin inside a jaw. This helps to remove uncertainty as to whether the work attachment is secured to the coupler.

The connection assembly disclosed herein provides an automated system to easily align and connect complementary hose connectors.

Further, the hose connection assembly helps to prevent damage of the hose connectors by eliminating knocks and preventing particulate matter from entering the connectors.

BRIEF DESCRIPTION OF THE DRAWINGS

Further aspects of the present invention will become apparent from the following description which is given by way of example only and with reference to the accompanying drawings in which.

BEST MODES FOR CARRYING OUT THE INVENTION

Figure 1:
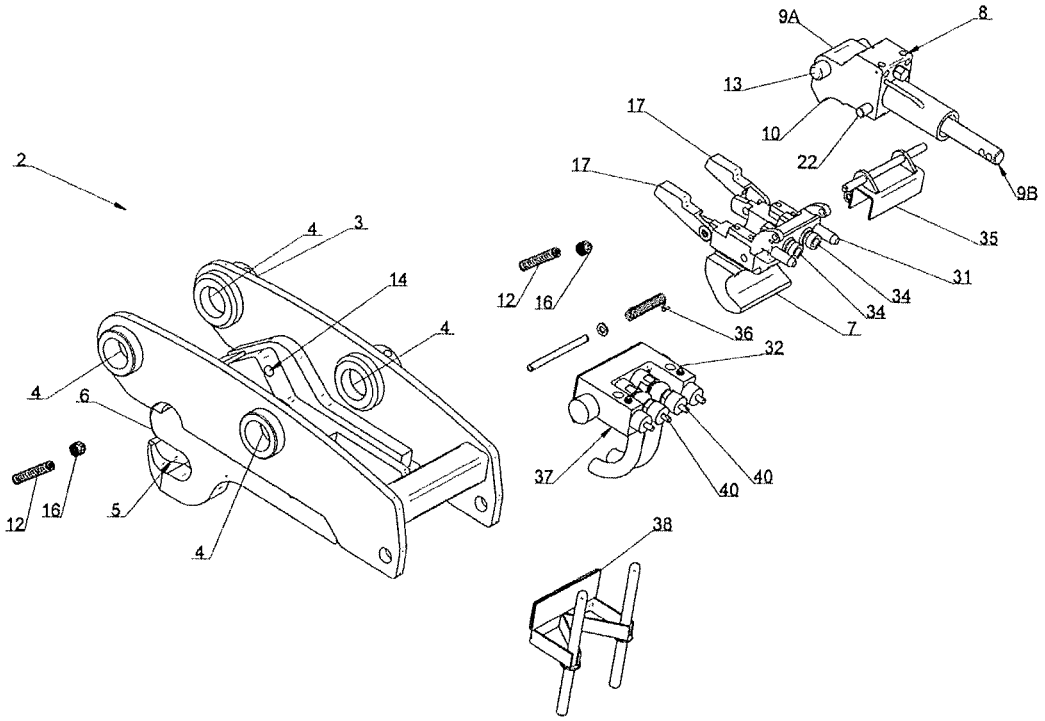
FIG. 1 is an exploded view showing the components of present invention.

The present invention relates to improvements to work attachment assemblies (1) for use with excavators (not shown in the drawings). Like numbers refer to like components throughout the Figures.

Figure 2:
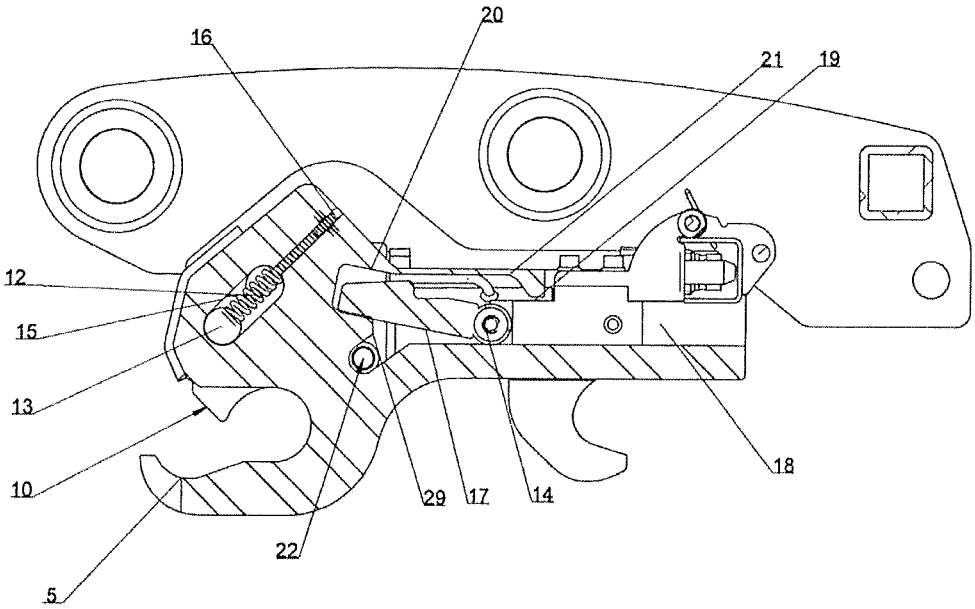
FIG. 2 is a side cross-sectional view of a coupler.

Referring to FIG. 1 which is an exploded view showing the components of the work attachment assemblies, and FIG. 2 showing a side cross-sectional view of a coupler (2). The components of the coupler (2) will be discussed in the order in which they are assembled.

The coupler (2) has a body (3) to house its components. The body (3) facilitates attachment of the coupler (2) to an excavator arm (not shown). The attachment is via apertures (4) through which fasteners (not shown) can extend. This is as should be known to those skilled in the art.

The body (3) has a first jaw (5) formed integrally at one end (6).

A hydraulic cylinder (8) is positioned within the body (3). A second jaw (7) is secured to the hydraulic cylinder (8) at its first end (9A).

The hydraulic cylinder (8) is configured to slide the second jaw (7) relative to the body (3) by expanding and contracting.

Second end (9B) of the hydraulic cylinder (8) is shaped to form a locking portion (10).

The hydraulic cylinder (8) is floatingly mounted and is able to move within the body (3). This movement is additional to the expansion and contraction of the hydraulic cylinder (8).

A snap lock mechanism (11) is formed from springs (12) and a pin (13). The pin (13) extends through the hydraulic cylinder (8) and into channels (15) in the body (3).

The springs (12) provide a biasing force against the pin (13) and thereby the hydraulic cylinder (8).

Nuts (16) allow the tension of the springs (12) to be adjusted.

Safety links (17) are pivotally mounted to the second jaw (7).

The body (3) has channels having a first section (19) and a second section (20). Stops (29) separate the first and second sections (19, 20).

Each channel (18) has a ridge (21) in the first section (19).

Protrusions (22) extend from the side of the actuator (8) to provide reset portions.

Figure 4A:
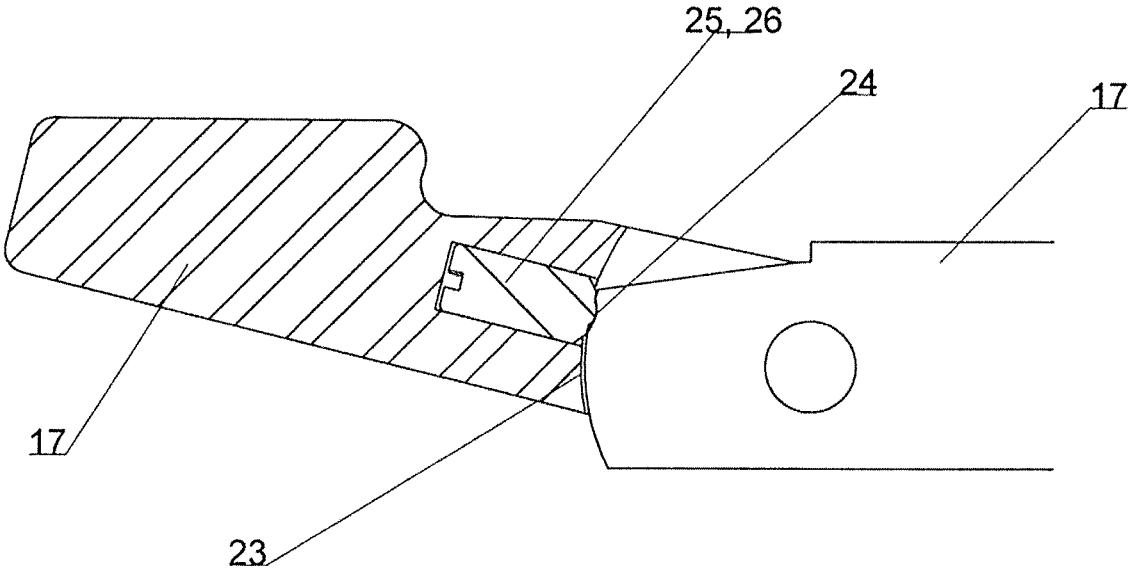
FIGS. 4A and 4B are a side view showing the safety link in the safety position and release position.
Figure 4B:
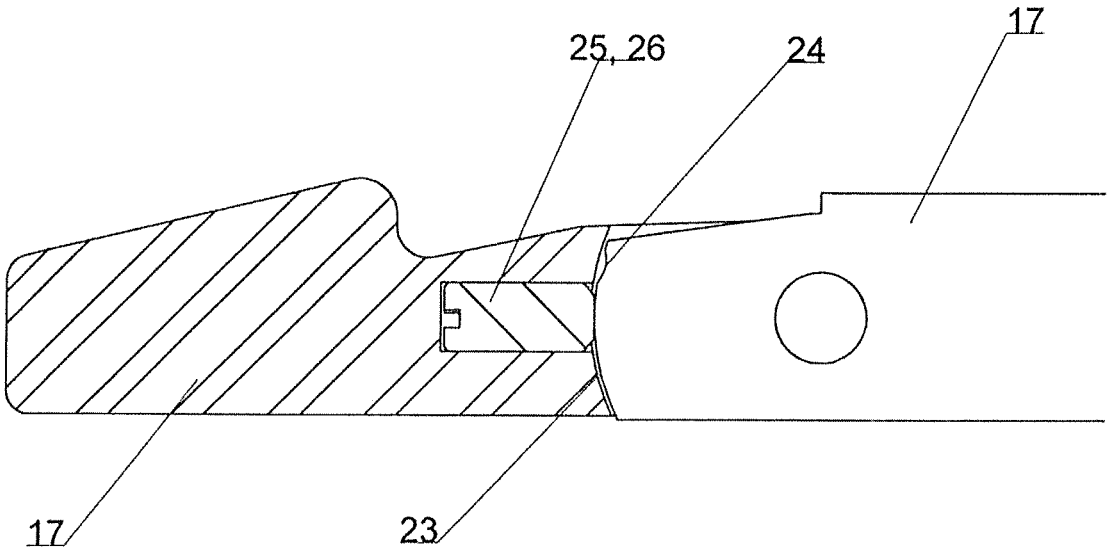

A restricting portion (23) is formed from a recess (24) on the jaw (7), and a spring (25) biased detent (26) in the safety link (17). The restricting portion (23) can be better seen in FIGS. 4A and 4B.

The relevance of the foregoing will become clearer from the following description of the coupler (2) in-use with reference to FIGS. 3 A-N.

An excavator arm manipulates the coupler so that it will engage a work attachment having a first pin (27) and a second pin (28). The first and second pins (27, 28) are parallel.

The first and second pins (27, 28) are shown in the Figures but the work attachment and excavator arm are not shown to simplify the Figures.

The first pin (27) presses against the locking portion (10). This overcomes the springs (12) to move the locking portion (10) and allow the pin (27) into the first jaw (5). Once the pin (27) is sufficiently inside the first jaw (5) the snap lock mechanism (12) forces the locking portion (10) into the locking position. This secures the pin (27) inside the first jaw (5).

The body (3) is tilted to position the second jaw (7) between the first pin (27) and second pin (28).

The hydraulic cylinder (8) expands to slide the second jaw (7) to engage the second pin. This is the position shown in FIG. 3E. The work attachment is now secured to the coupler (2) and can operate as should be known to those skilled in the art.

It should be noted that the safety links (17) do not touch the ridges (21).

To release the work attachment (not shown) the second jaw (7) is moved so that it releases the second pin (28).

The coupling (2) is tilted with respect to the work attachment (not shown). This brings the second jaw (7) out of alignment with the second pin (28). The hydraulic cylinder (8) expands to move the second jaw (5). As the second jaw (7) is not in line with the second pin (28) the hydraulic cylinder can expand past the position in which the second jaw (7) engages the second pin (28).

This movement is in the opposite direction to that in which the second jaw (7) moves to release the second pin (28).

This action causes the safety links (17) to touch the ridges (21). The ridges (21) press against the safety links (17) forcing them into the release position.

Figure 3A:
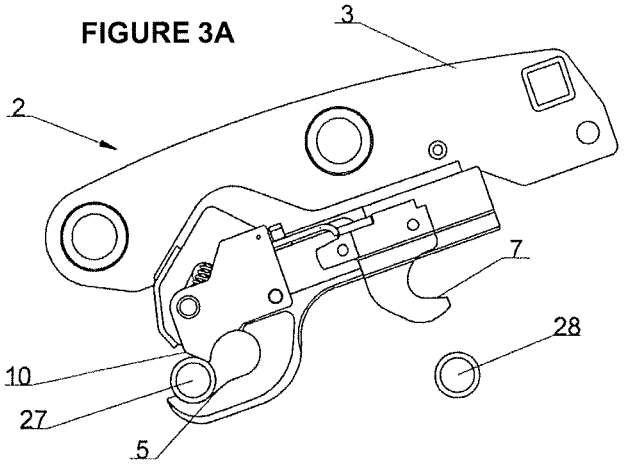
FIGS. 3A-N are side cross-sectional schematics showing operation of the coupler.
Figure 3B:
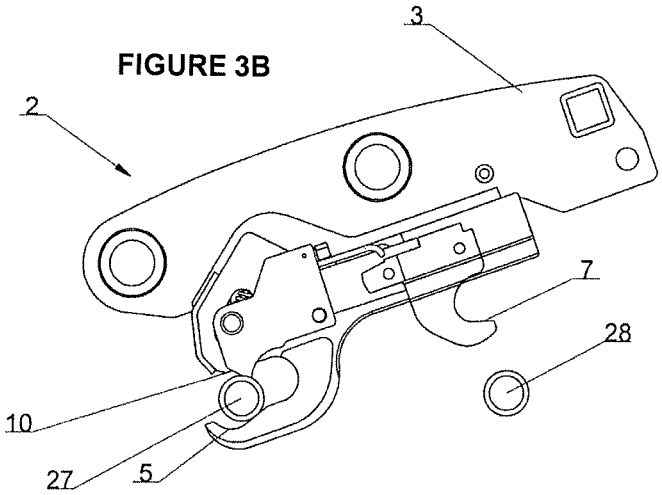
Figure 3C:
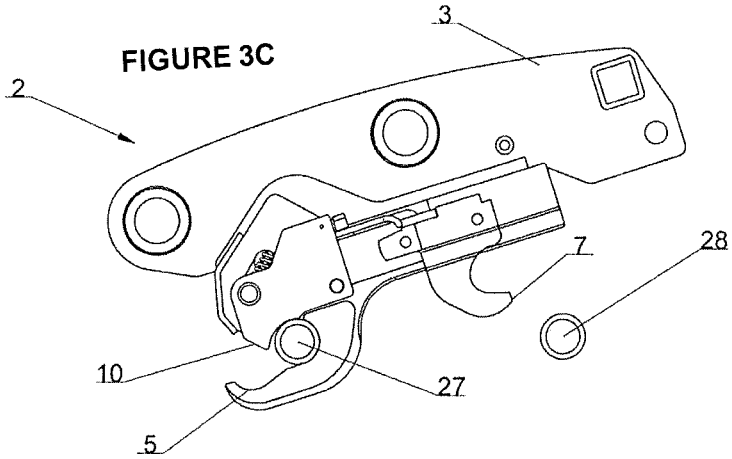
Figure 3D:
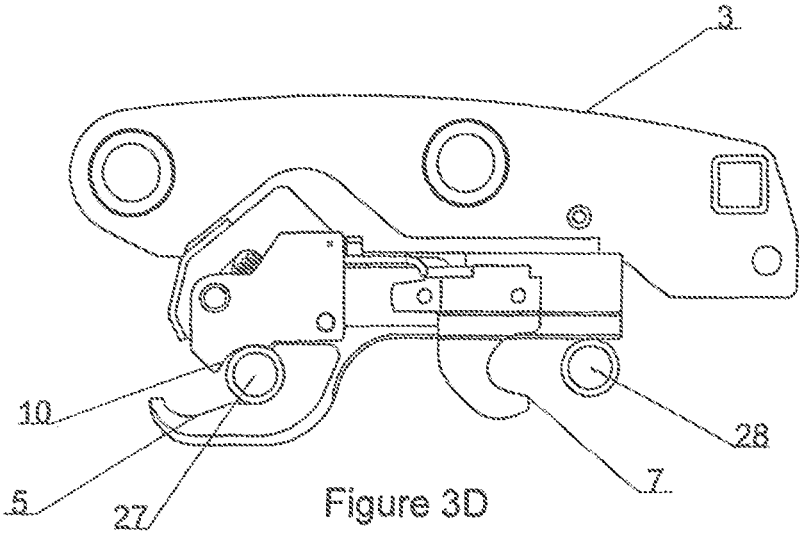
Figure 3E:
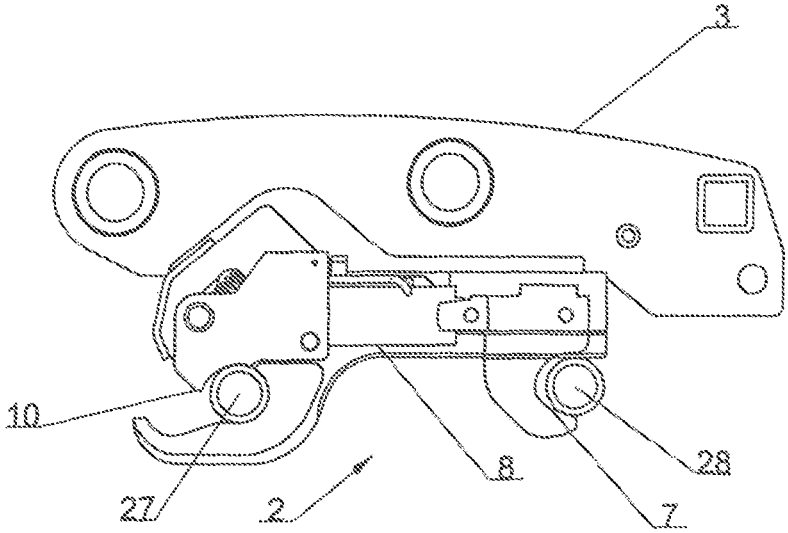
Figure 3F:
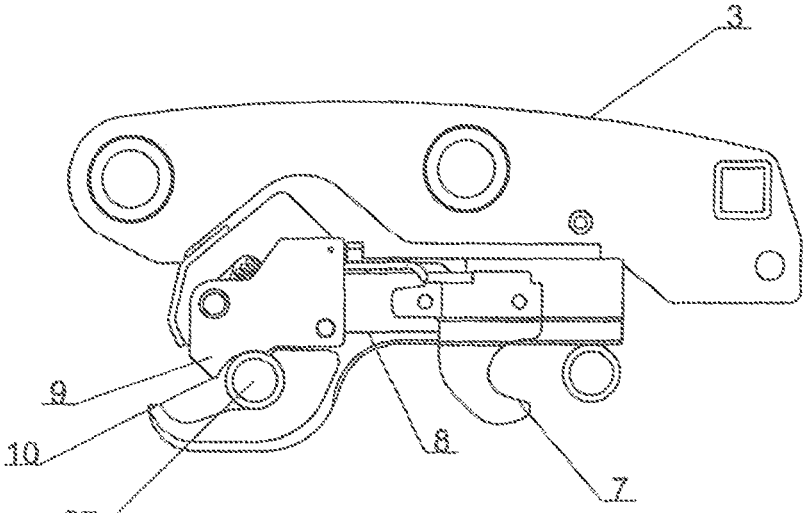
Figure 3G:
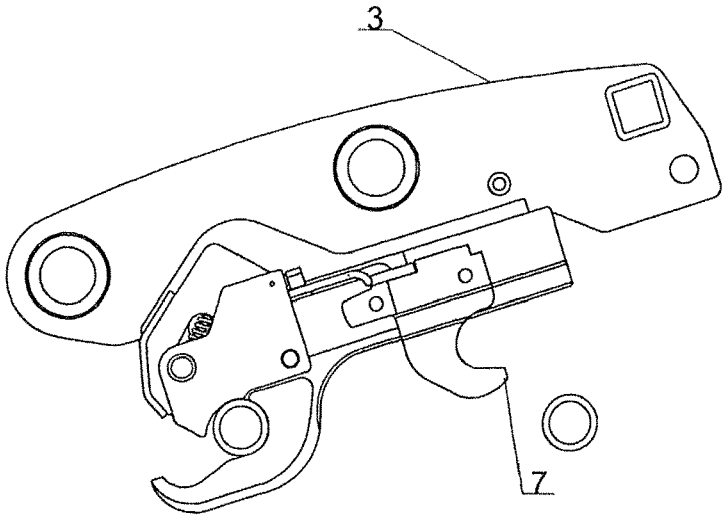
Figure 3H:
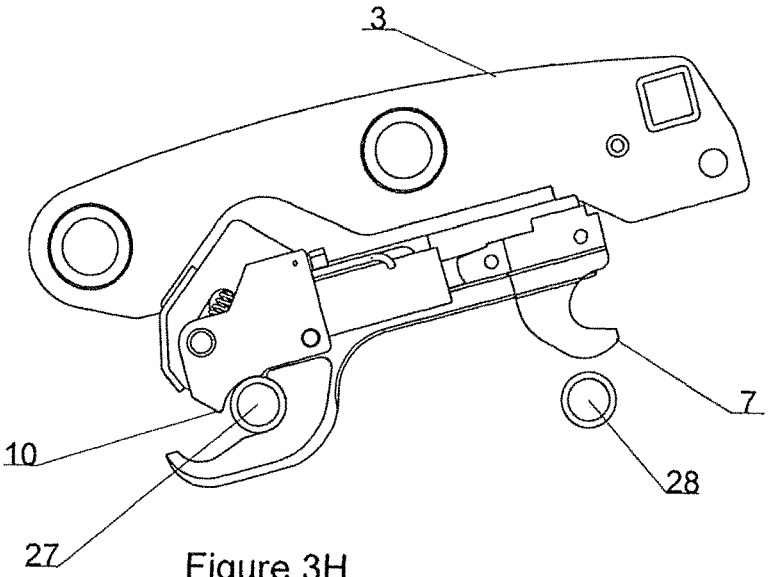
Figure 3I:
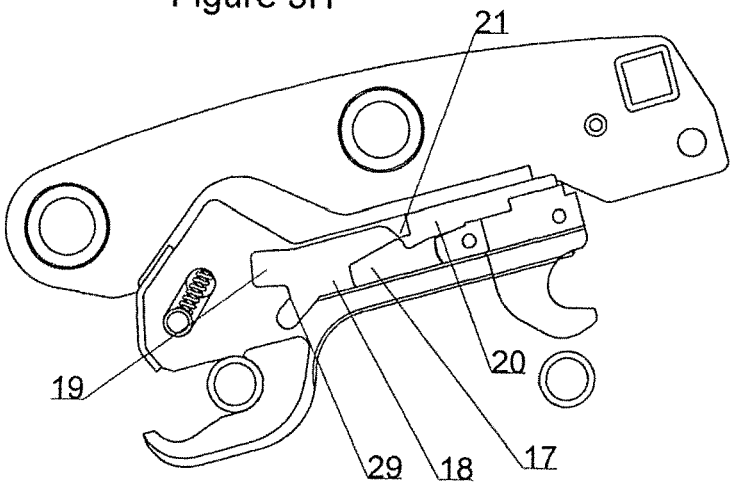
Figure 3J:
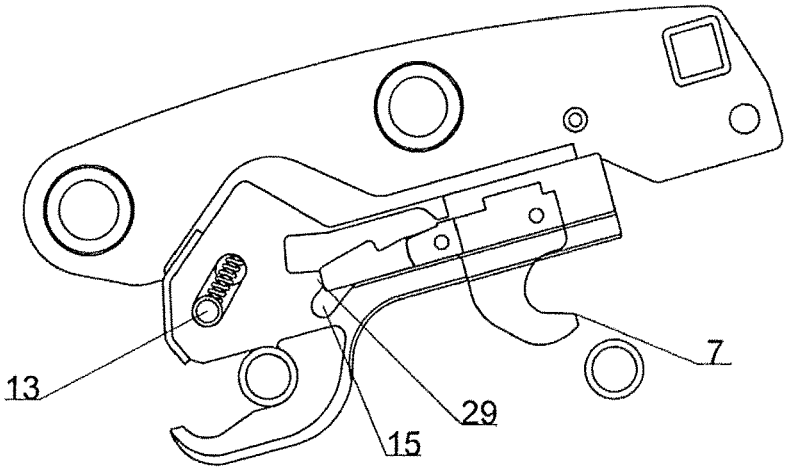
Figure 3K:
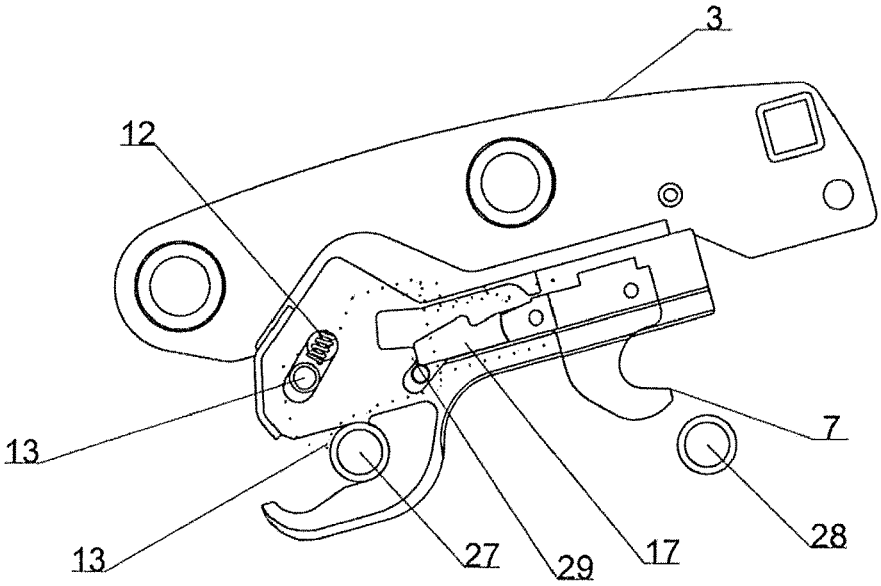
Figure 3L:
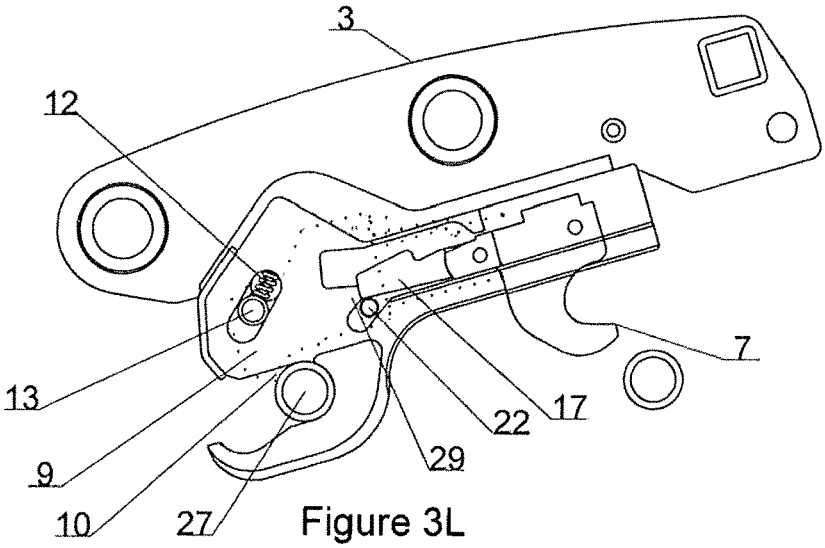
Figure 3M:
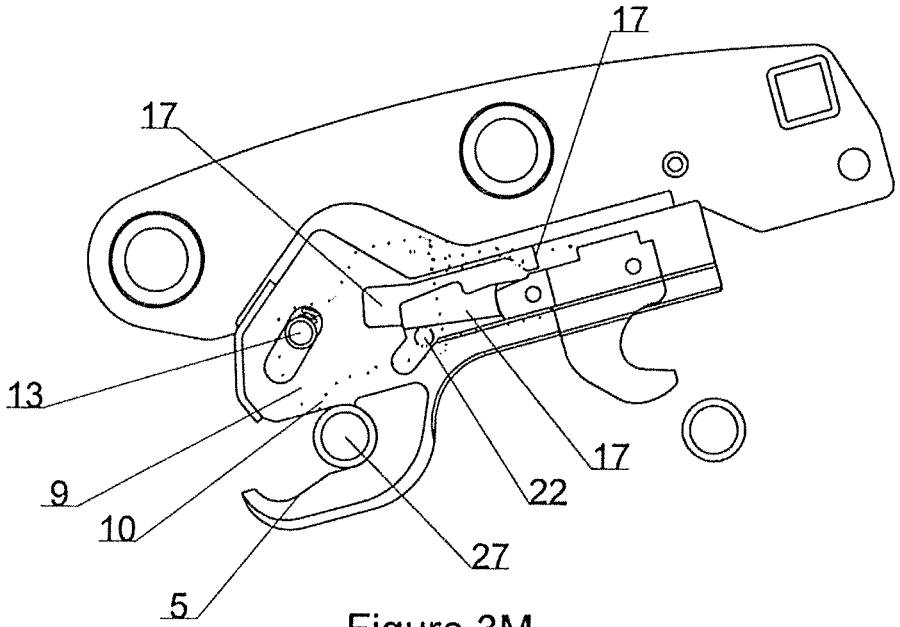
Figure 3N:
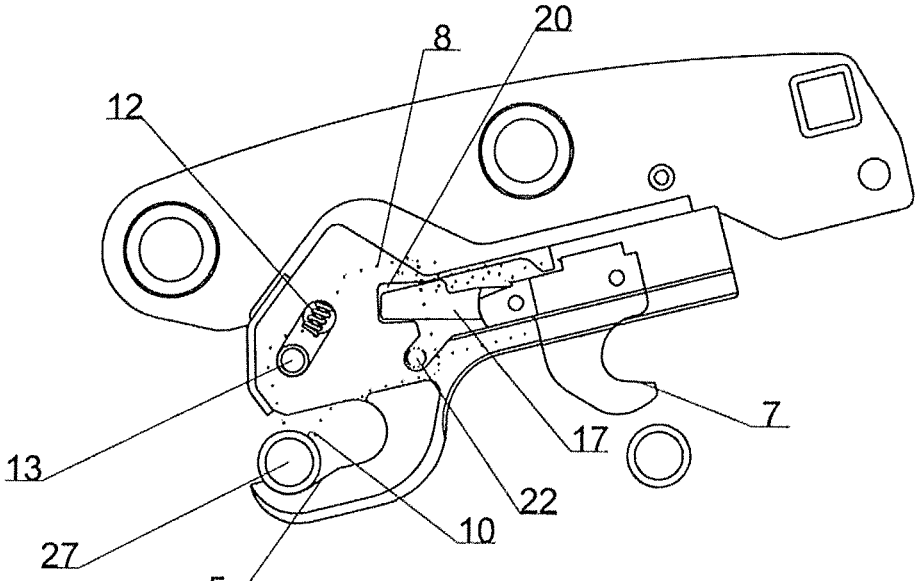

FIG. 3I is the same as FIG. 3H but without the hydraulic cylinder (8) shown. This allows the safety links (17) to be clearly seen and that these are in the release position.

The operator sends a signal to the hydraulic cylinder (8) to contract. This moves the second jaw (7) in the opposite direction i.e. the same direction that the second jaw (7) moves to release the second pin (27). The second jaw (7) is moved until the safety links (17) abut the stops (29). This prevents the hydraulic cylinder (8) moving the second jaw (7).

The hydraulic cylinder (8) continues to contract. As the safety links (17) abut the stops (29) this causes the end (9B) of the hydraulic cylinder (8) to move. The path of the end (6) is controlled by the pin (13) travelling in the channels (15). This causes the locking portion (10) to move out of the first jaw (5) thereby releasing the first pin (27) from the first jaw (5).

FIGS. 3K-3N show the hydraulic cylinder in dotted outline.

The safety links (17) therefore cause contraction of the hydraulic cylinder (8) to move the locking portion (10). This releases the first pin (27) from the first jaw.

The coupler (2) can then be moved away from the work attachment.

The protrusions (22) press against to the safety links (17) forcing them to move away from the stops (29) and align with the second section (20) of the channels (18). This allows the hydraulic cylinder (8) to extend thereby forcing the locking portion (10) back into the first jaw (5). This resets the snap lock mechanism.

Figure 5A:
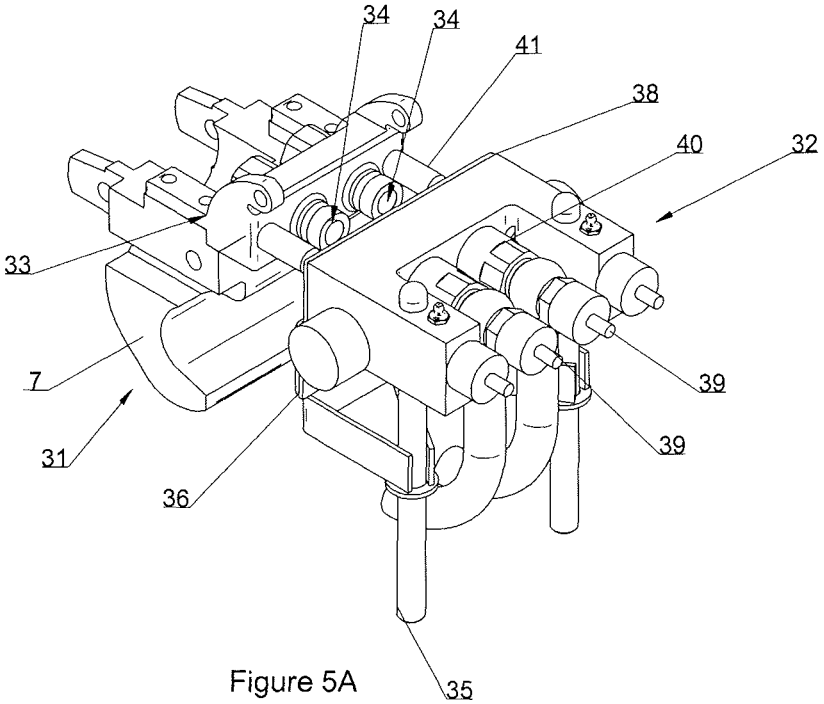
FIGS. 5A and 5B are front and side perspective views of the first and second components of a connection assembly.
Figure 5B:
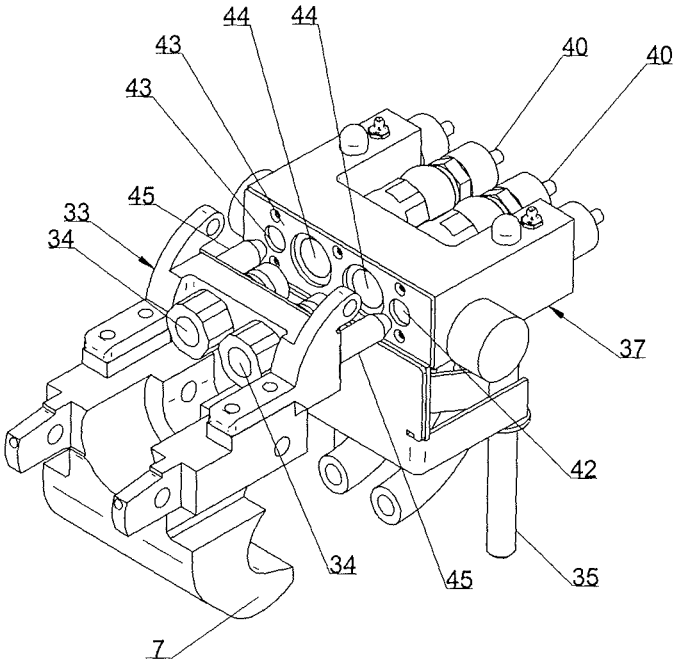
Figure 6A:
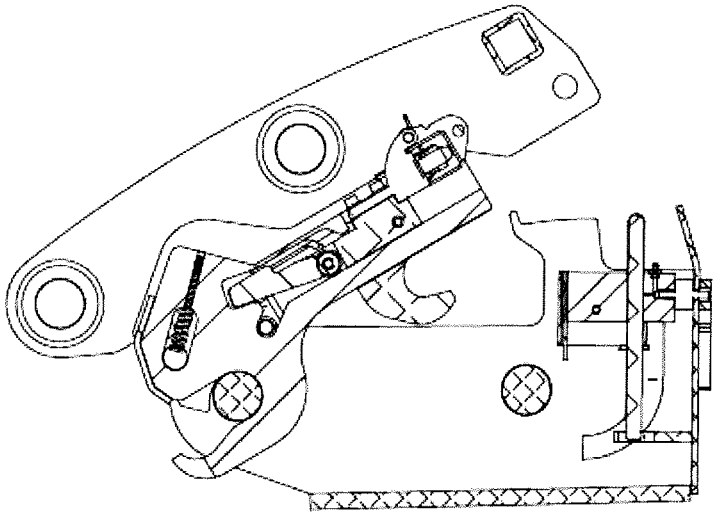
FIGS. 6A-F are a side cross-sectional schematic showing operation of a connection assembly.
Figure 6B:
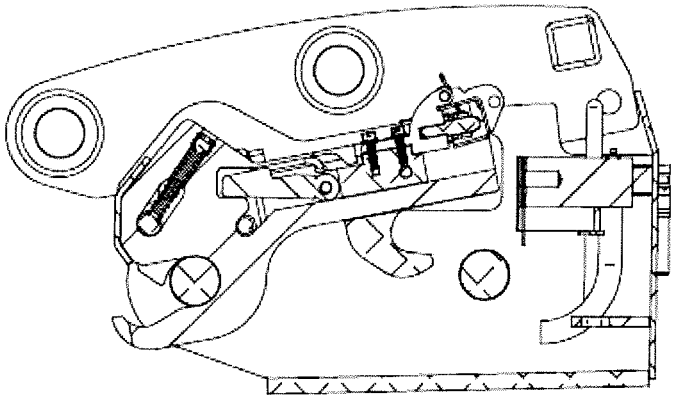
Figure 6C:
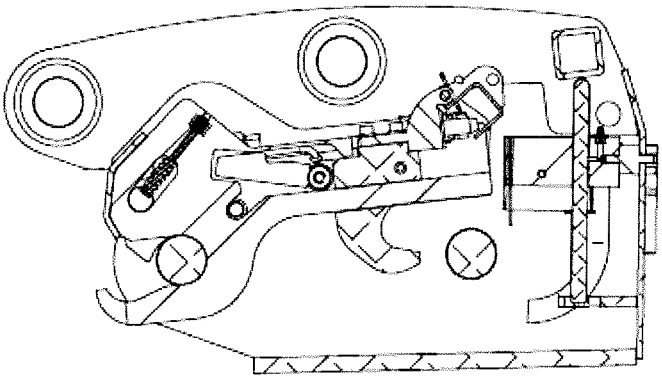
Figure 6D:
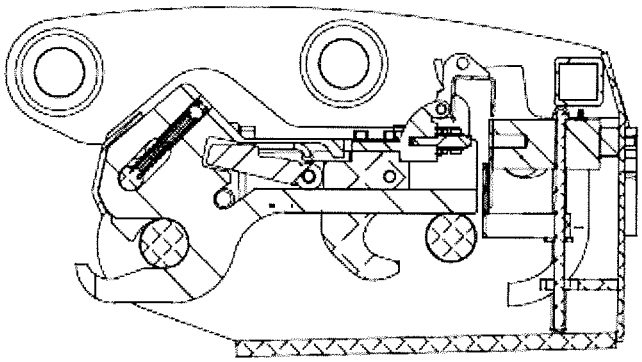
Figure 6E:
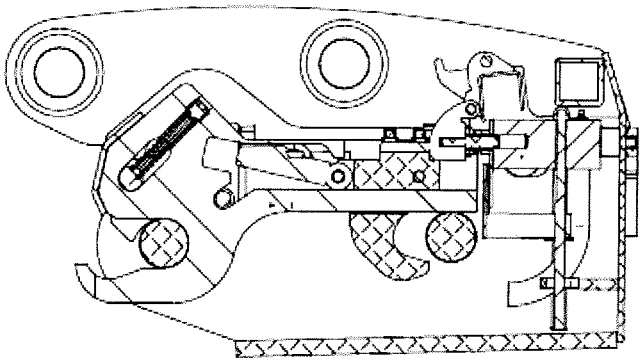
Figure 6F:
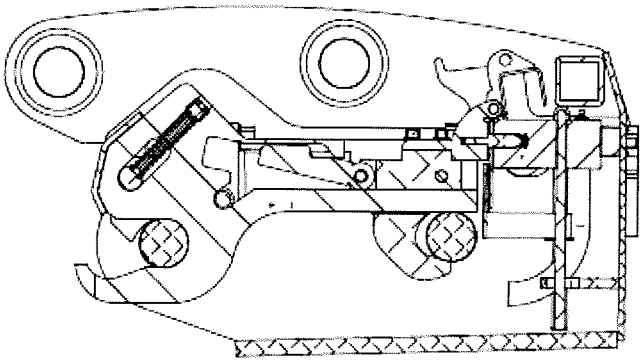

Referring now to FIGS. 1, 5A and 5B which show the components of a connection assembly (30) to provide a connection between hydraulic actuators on a work attachment and a control system (not shown in the Figures for ease of reference).

Figure 9A:
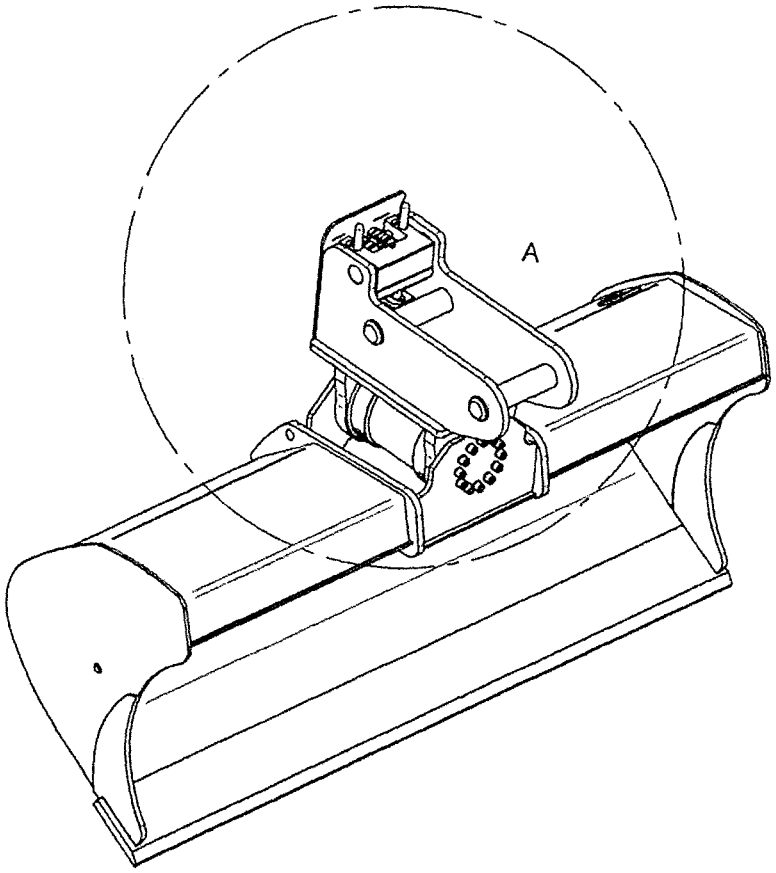
FIGS. 9 A & B are view of a tilt bucket having part of a connection assembly according to the present invention secured thereto.
Figure 9B:
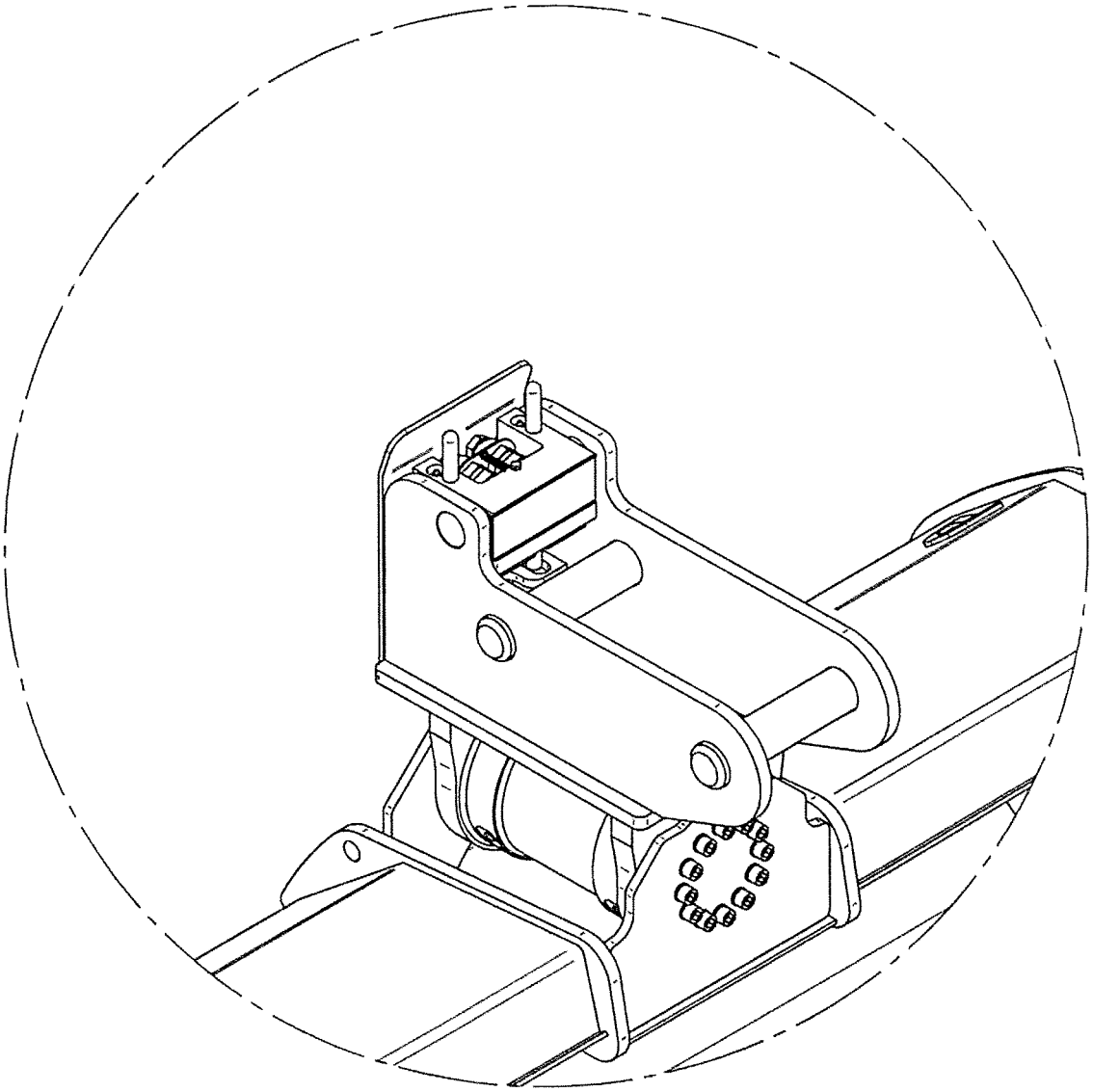

The connection assembly (30) is formed from a first component (31) and a second component (32). The first component (31) is mounted on the second jaw (7) of the coupler (2). The second component (32) is mounted on a work attachment as is shown in FIGS. 9A & B.

The first component (31) has a mounting (33) with a plurality of male hose connectors (34). A first guard (35) is pivotally attached to the mounting (33).

A spring (36) biases the first guard (35) to a closed position in which it protects the male connectors (34).

The second component (32) has a mounting (37) in the form of a housing and a second guard (38) slideably attached to the mounting (32). A spring (not shown) biases the second guard (38) to a closed position.

A set of female hose connectors (40) are mounted inside the housing.

The female connectors (40) and male connectors (34) are complementary and can engage each other to provide a connection between the control system and actuators on the work attachment.

The second component (32) has a plate (43) with openings (44). The male connectors (34) can be inserted through the openings (44).

The female connectors (40) have latches (41) which secure the male connectors (34) to them. The latches (40) release the male connectors (33) when moved along the length of the female connector (39).

Referring now to FIGS. 6A-6F which are side schematics showing the connection assembly (30) in use.

The coupler (2) is positioned so that jaw (5) receives pin (27). The coupler (2) is tilted to move the second jaw (7) between pins (27,28). This action causes the coupler (2) to force guard (38) to slide down and expose the female connectors (40).

The action of tilting the coupler (2) between the pins (27, 28) also causes the guard (35) to move thereby exposing the male connectors (34). This is due to member ( ) on the guard (35) contacting a portion on the second component (32). This contact prevents the guard (35) tilting with the coupler (2) so that in effect the guard pivots with respect to the coupler (2) to expose the connectors (34)

The second jaw (7) moves forward causing a corresponding movement in the first component (31).

Tapered members (45) extend into openings (46). The members (45) help to ensure alignment of the hose connectors (34, 40) so that they can engage.

The second jaw (7) continues moving causing the male and female connectors (34, 40) to engage. This provides a connection between a hydraulic cylinder and a control system (neither shown in the FIGS. 6A-6F).

To release the connectors (34,40), the second jaw (7) is moved. This moves the first component (31) away from the second component (32) thereby causing the latches to abut the edges of the openings (44). The latches (39) are moved along the length of the female connector (38) thereby releasing the engaged connectors (34,40).

Springs (36) force the guards (35, 38) back to the closed position. The guards can therefore protect the connectors (34, 40) when not in use.

Referring now to FIGS. 7A-7G, and 8 which show an alternative embodiment of a coupler (46) according to the present invention.

The coupler (46) has a body (47) with a first jaw (48) formed integrally at one end (49). A second jaw (50) is positioned inside the body (47). The second jaw (50) is able to slide with respect to the body (47).

A hydraulic cylinder (51) is floatingly mounted in the body (47). The second jaw (50) is secured to the hydraulic cylinder (51) at its first end (52).

The hydraulic cylinder's second end (53) is shaped to define a locking portion (54).

Torsion springs (55) are mounted in the body (47) and abut against the hydraulic cylinder (51). The torsion springs (55) exert a biasing force that urge the hydraulic cylinder (51) and therefore the locking portion (54), towards a locking position.

Figure 7A:
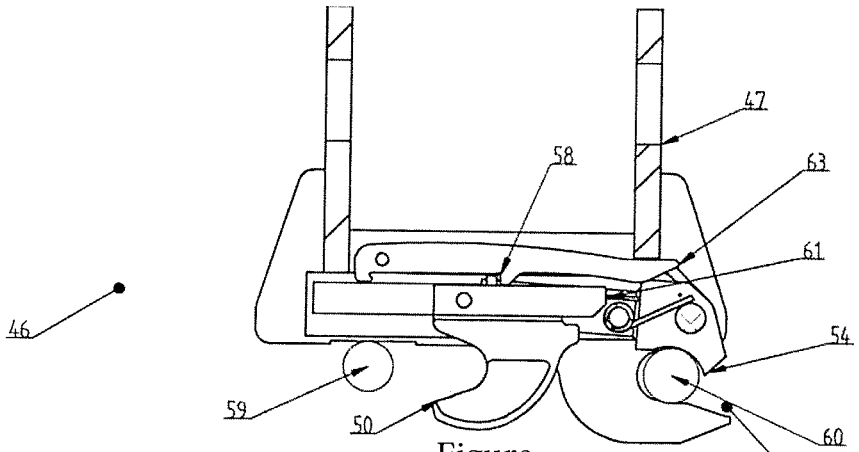
FIGS. 7 A-7 G are side cross-sectional views of an alternative embodiment of a coupler according to the present invention.
Figure 7B:
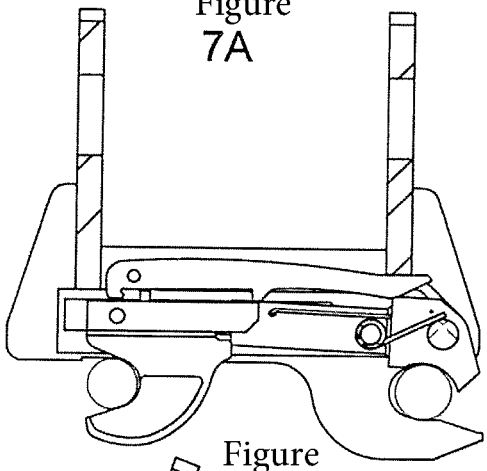
Figure 7C:
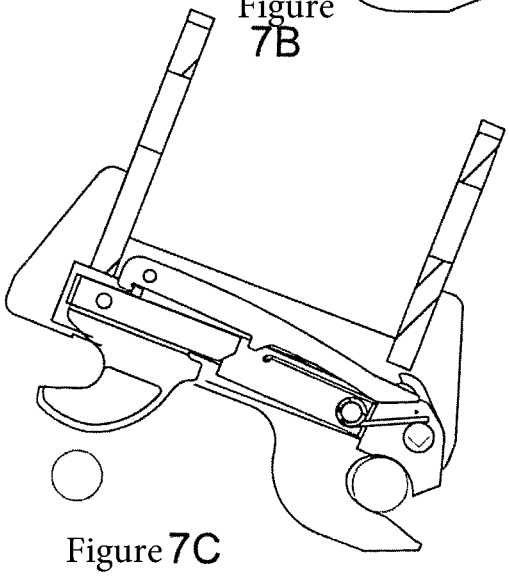
Figure 7D:
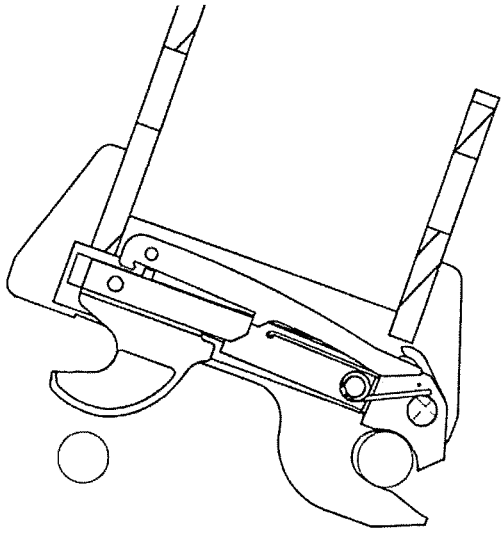
Figure 7E:
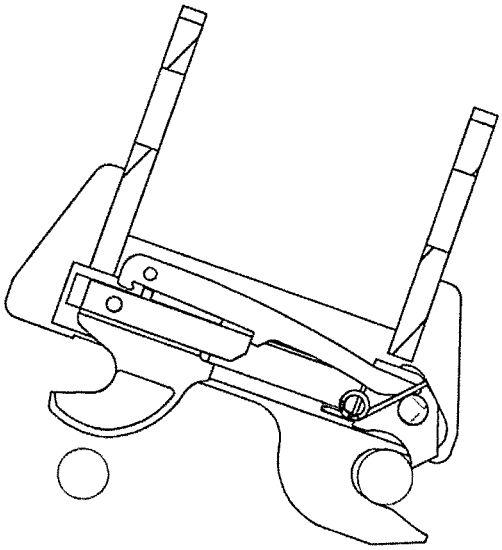
Figure 7F:
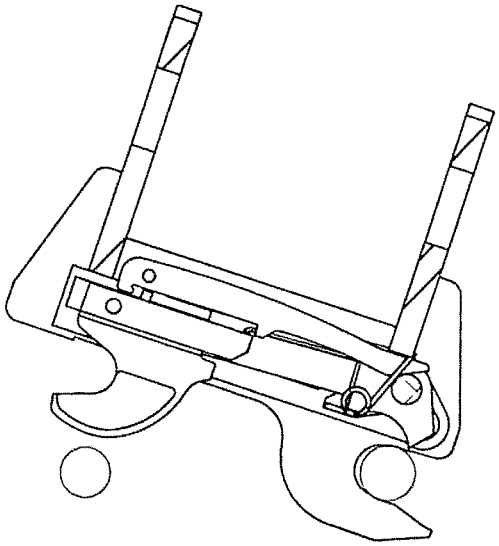
Figure 7G:
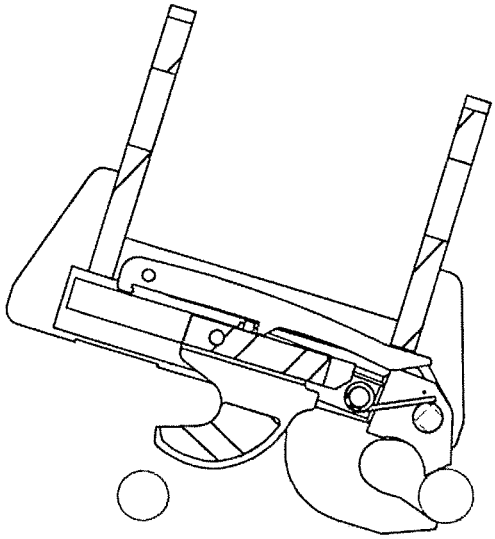
Figure 8:
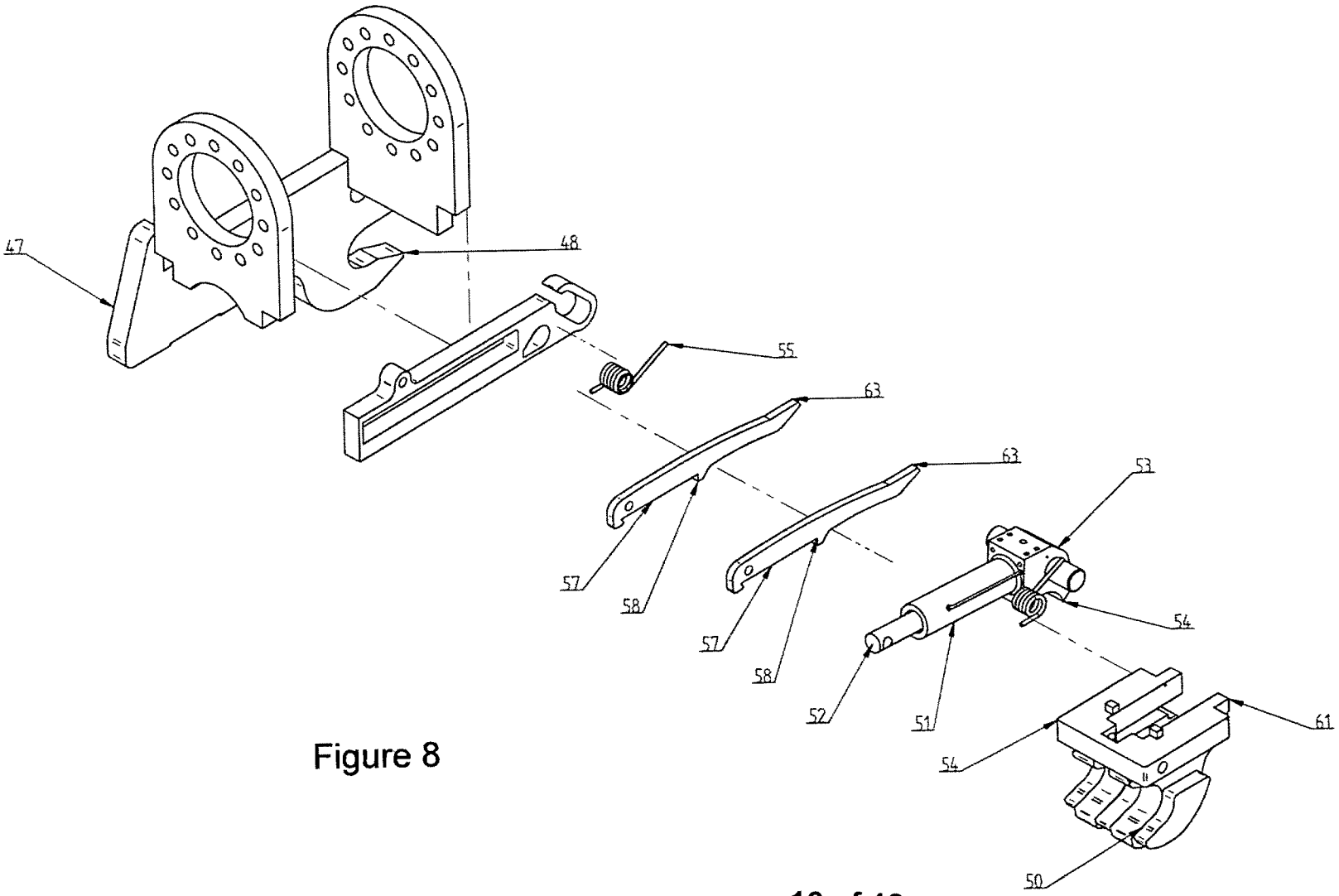
FIG. 8 is an exploded view of components of the alternate embodiment of the coupler.

The locking portion (54) sits across the entrance (56) to first jaw (48). This is shown in FIG. 7A.

Safety links (57) are pivotally mounted to the body (47) above the second jaw (50). The safety links (57) have protrusions (58).

In use, the coupler (46) is positioned so that a pin (59) presses against the locking portion (54). This overcomes the urging force of the torsion springs (55) and moves the locking portion (54) from the entrance (50) to first jaw (48). This allows the pin (59) to be inserted into the first jaw.

When the pin (59) is inside the jaw (48) the torsion springs (55) force the locking portion (54) back across the entrance (56) to secure the pin inside the first jaw (48).

The coupler (46) is tilted so that second jaw (50) is between pin (59) and a second pin (60).

The hydraulic cylinder (51) is caused to expand which slides the second jaw (50) with respect to the body (47).

The second jaw (50) receives the second pin (60) and thereby secures the work attachment (not shown) to the coupler (40). The work attachment can then be used as per normal operation.

To release the work attachment (not shown) the hydraulic cylinder (51) is caused to contract. This slides the second jaw (50) with respect to the body to release the second pin (60).

The coupler (46) is tiled so that the second jaw (51) is brought of alignment with the second pin (60).

The hydraulic cylinder (51) is caused to expand to move the second jaw (50) past the position in which it engages the second pin (60). This causes the second jaw (50) to move so that edge (61) is past the protrusions (58). This allows the safety links (57) to pivot downward. In this position the protrusions (58) are no longer above the top (62) of the jaw (50).

The hydraulic cylinder (51) contracts causing edge (61) to abut protrusions (58). This prevents first end (52) and the second jaw (50) moving further within the body (47).

The hydraulic cylinder (51) continues to contract. As the hydraulic cylinder (51) is floatingly mounted within the body (47) the second end (53) is moved. This causes the locking portion (54) to be moved away from entrance (56) to the first jaw (48). First pin (59) therefore is released from the first jaw (56) and therefore the coupler (46).

The coupler (46) can be moved away from the work attachment (not shown).

Hydraulic cylinder (51) continues to contract. Safety links (57) abut against detents (63). This lifts the safety links (57) above edge (61) of the second jaw (50). The torsions springs ( ) force the locking portion (54) across entrance (56) to the first jaw (48). This allows hydraulic cylinder (51) to expand slightly towards the first jaw (50). Simultaneously the protrusions (58) are again above the top (64) of second jaw (50). This resets the safety links (57) to the safety position.

Aspects of the present invention have been described by way of example only and it should be appreciated that modifications and additions may be made thereto without departing from the scope thereof.

Aspects of the present invention have been described by way of example only and it should be appreciated that modifications and additions may be made thereto without departing from the scope thereof as defined in the appended claims.

The invention claimed is:

1. A coupler, comprising:

a body;

a first jaw that is moveable with respect to the body to engage a first pin on a work attachment;

a second jaw that does not move with respect to the body, wherein the second jaw has an opening to a cavity, and wherein the opening is configured to enable a second pin on the work attachment to be inserted into the second jaw;

an actuator having a first end and a second end, wherein the first end is connected to the first jaw to enable the actuator to move the first jaw; and a locking mechanism to secure the second pin in the second jaw when inserted therein in use, the locking mechanism comprising a locking portion and a biasing element, wherein the locking portion is moveable to a locking position in which the locking portion at least partially obstructs the opening to the second jaw to prevent the second pin being withdrawn from the second jaw, wherein the locking portion is rigidly fixed with respect to the second end of the actuator so that the locking portion moves through the same path as the second end of the actuator, and further wherein the locking portion does not rotate relative to the second end of the actuator, wherein the biasing element provides an urging force to bias the locking portion towards the locking position, and further wherein the coupler is configured such that contraction of the actuator causes the second end of the actuator to move, thereby also causing the locking portion to move sufficiently so as to enable the second pin to be removed from the second jaw when inserted therein.

2. The coupler in claim 1, wherein a portion of the actuator is shaped to provide the locking portion.

3. The coupler in claim 1, wherein the actuator is mounted in the coupler so that at least the second end of the actuator can move with respect to the body.

4. The coupler in claim 3, comprising a track to guide movement of the second end of the actuator through a pre-determined range of movement.

5. The coupler in claim 4, wherein the track is configured to guide contraction of the actuator to move the locking portion to a release position that allows the second pin to be withdrawn from the second jaw.

6. The coupler in claim 1, wherein the first jaw is configured to slide with respect to the body.

7. The coupler in claim 1, wherein the coupler is configured to secure the second pin in the second jaw regardless of whether the first jaw engages the first pin on the work attachment.

8. The coupler in claim 1, wherein the second jaw provides a front jaw of the coupler.

9. The coupler in claim 1, wherein the second jaw is oriented to face in a direction substantially opposite the first jaw.

10. The coupler in claim 1, wherein the biasing element is a compression spring, and further wherein the compression spring is positioned and configured such that movement of the second end of the actuator to move the locking portion out of the opening of the second jaw compresses the compression spring.

11. The coupler in claim 10, wherein the compression spring is configured to apply an urging force to the locking portion to move it towards a position in which the locking portion at least partially obstructs the opening in the second jaw when hydraulic pressure in the actuator is released.

12. The coupler in claim 9, wherein the first jaw provides a rear jaw of the coupler.

13. The coupler in claim 11, wherein the compression spring is positioned and configured so that force applied to the locking portion by the second pin can overcome the locking portion to move the locking portion sufficiently to enable a pin to be inserted into the second jaw.

14. The coupler in claim 1, wherein the locking mechanism comprises the locking portion which is moveable to the locking position in which it at least partially obstructs the opening to the second jaw.

* * * * *